US007628460B1

(12) United States Patent
Huang

(10) Patent No.: US 7,628,460 B1
(45) Date of Patent: Dec. 8, 2009

(54) WHEEL TYPE DRAWER PULLING FORCE ADJUSTING APPARATUS

(75) Inventor: Kuo-Sheng Huang, Taipei County (TW)

(73) Assignee: Nan Juen International Co., Ltd., Taipei County (TW)

( * ) Notice: Subject to any disclaimer, the term of this patent is extended or adjusted under 35 U.S.C. 154(b) by 0 days.

(21) Appl. No.: 12/187,548

(22) Filed: Aug. 7, 2008

(51) Int. Cl.
*A47B 88/00* (2006.01)

(52) U.S. Cl. ..... 312/333; 312/334.44

(58) Field of Classification Search ..... 312/333, 312/334.44–334.47; 384/21
See application file for complete search history.

(56) References Cited

U.S. PATENT DOCUMENTS 5,775,787 A * 7/1998 Gasser ..... 312/333
6,402,274 B1 * 6/2002 Reis ..... 312/334.46
6,497,464 B1 * 12/2002 Cammack et al. ..... 312/333
6,789,862 B2 * 9/2004 Shih-Long et al. ..... 312/334.46
7,159,958 B1 * 1/2007 Lu ..... 312/334.44
7,229,142 B2 * 6/2007 Lin ..... 312/333
2005/0074190 A1 * 4/2005 Traiser et al. ..... 384/21

FOREIGN PATENT DOCUMENTS

DE 3425517 * 1/1986 ..... 312/334.45

* cited by examiner

*Primary Examiner*—Hanh V Tran
(74) *Attorney, Agent, or Firm*—Muncy, Geissler, Olds & Lowe, PLLC

(57) ABSTRACT

A wheel type drawer pulling force adjusting apparatus is installed to a slide module having a bottom rail, a middle rail and an internal rail. A latch member is fixed to the bottom rail. The slidable middle rail is embedded onto the bottom rail. The internal rail is embedded and slidable on the middle rail. A limit member and a turning wheel are embedded on the internal rail and the bottom rail opposite to the latch member. Positioning slots of different sizes are on the turning wheel. The internal rail is connected with a drawer. During installation, the size of the positioning slots of the turning wheel latched by the limit member determines the level of retracting the limit member, and the tightness of the limit member latched to the latch member of the bottom rail is adjusted to allow users to apply an appropriate force to open the drawer.

6 Claims, 6 Drawing Sheets

WHEEL TYPE DRAWER PULLING FORCE ADJUSTING APPARATUS

BACKGROUND OF THE INVENTION

1. Field of the Invention

Further, the bottom rail 10 includes a middle rail 20 (which is substantially a U-shaped frame and there is only one middle rail 20 used in this embodiment) embedded onto the bottom rail 10, and an internal rail 30 (which is substantially a U-shaped frame and there is only one internal rail 30 used in this embodiment) embedded onto the bottom rail 10 and coupled with a drawer (not shown in the figure). The internal rail 30 includes a limit member 31 movably disposed on a surface of the bottom rail 10, and the limit member 31 includes a base 311 secured into the internal rail 30 by a screw rod 312, and symmetric clamping arms 313 are extended respectively outward from both lateral sides of the base 311, and the height of the clamping arms 313 is higher than the base 311, and a separate embedding member 314 is disposed perpendicular to an open end of the clamping arms 313, and a first plate member 315 is extended horizontally and respectively from an end of embedding members 314 away from the clamping arms 313.

2. Description of the Related Art

Further, a turning wheel 32 is installed between the internal rail 30 and the limit member 31, and the turning wheel 32 is a circular plate member in this embodiment, and a rib portion 321 is passed through the turning wheel 32 and secured onto the internal rail 30 by a screw rod 322, and positioning slots 323 with different internal diameters or sizes are disposed concavely and respectively on an internal side of the turning wheel 32.

Referring to FIGS. 7 and 8 for the installation, the middle rail 20 and the internal rail 30 are installed sequentially on the bottom rail 10, and the latch member 11 is fixed to an end of the bottom rail 10. In FIGS. 5 and 6, the turning wheel 32 is turned to a specific position if needed, so that the first and second plate members 315 at both ends of the limit member 31 are passed through the turning wheel 32 respectively and leaned onto another side of the turning wheel 32 for engaging an embedding member 314 (not shown in the figure) with the corresponding positioning slot 323. The level of retracting the clamping arms 313 of the limit member 31 is determined by the internal diameter or size of the positioning slots 323 and the tightness of the clamping arms 313 of the limit member 31 latched to the latch member 11 depends on the level of retracting the clamping arms 313, such that the installed bottom rail 10 of the slide module 1 is fixed onto a lateral side of the cabinet (not shown in the figure) to allow users to apply an appropriate force to open the drawer. The present invention achieves the simple-to-install and convenient-to-use effects.

To overcome the foregoing shortcomings, a retention mechanism as disclosed in R.O.C. Pat. Application No. 93216385 and shown in FIG. 2 includes a bottom rail 200', and an end of the bottom rail 200' includes two corresponding flanges 201' with a predetermined interval between the flanges 201', and the bottom rail 200' has a pull slide 300' disposed thereon, and the pull slide 300' has an adjusting latch element 310 pivotally disposed on a surface facing towards the bottom rail 200, and the adjusting latch element 310' has a latch pillar 311' protruded towards the bottom rail 200' and a flange 312' fixed under the latch pillar 311' with a height difference, and the adjusting latch element 310' has a set of elastically flexible latch 313', and the pull slide 300' has a rotating wheel 320' pivotally connected to an adjacent entering position of the adjusting latch element 310', and the rotating wheel 320' has a guide slot 321' disposed along the periphery of the rotating wheel 320' for precisely inserting the latch pillar 311'. The device with this structure can drive the adjusting latch element 310' by the rotating wheel 320' to extend the latch 313' on the adjusting latch element 310' into the interval of the flanges 201' to a certain depth for adjusting the pulling force. The shallower the extension, the looser is the pulling force; and the deeper the extension, the tighter is the pulling force, and the lesser is the effort required for pulling a drawer. Since the prior art requires complicated components and incurs a high cost, and the device gets stuck easily during the rotating process, the prior art requires improvements.

SUMMARY OF THE INVENTION

In view of the shortcomings of the conventional drawer pulling force adjusting apparatus, the inventor of the present invention based on years of experience in the related field to conduct extensive researches and experiments, and finally developed a wheel type drawer pulling force adjusting apparatus in accordance with the present invention to overcome the shortcomings of the prior art.

Therefore, it is a primary objective of the present invention to provide a wheel type drawer pulling force adjusting apparatus installed on a slide module having a bottom rail, a middle rail and an internal rail, wherein a latch member is fixed to the bottom rail, and the slidable middle rail is embedded onto the bottom rail, and the internal rail is slidably embedded onto the middle rail, and a limit member and a turning wheel are embedded onto the internal rail and the bottom rail opposite to the latch member, and positioning slots of different sizes are disposed on an internal side of the turning wheel, and the internal rail is connected with a drawer. During installation, the turning wheel is turned to a specific angle depending on actual needs, and the turning wheel is fixed after the limit member is latched into the turning wheel, such that the limit member changes its level of retraction according to the internal diameter or size of the positioning slots, and the tightness of the limit member latched to the latch member of the bottom rail is adjusted to allow users to apply an appropriate force to open the drawer, and thus the invention can achieve the simple-to-install and convenient-to-use effects.

To make it easy for our examiner to understand the above and other objects, features and advantages of the present invention, we use preferred embodiments accompanied with the related drawings for the following detailed description of the invention.

DETAILED DESCRIPTION OF THE PREFERRED EMBODIMENTS

Figure 1:
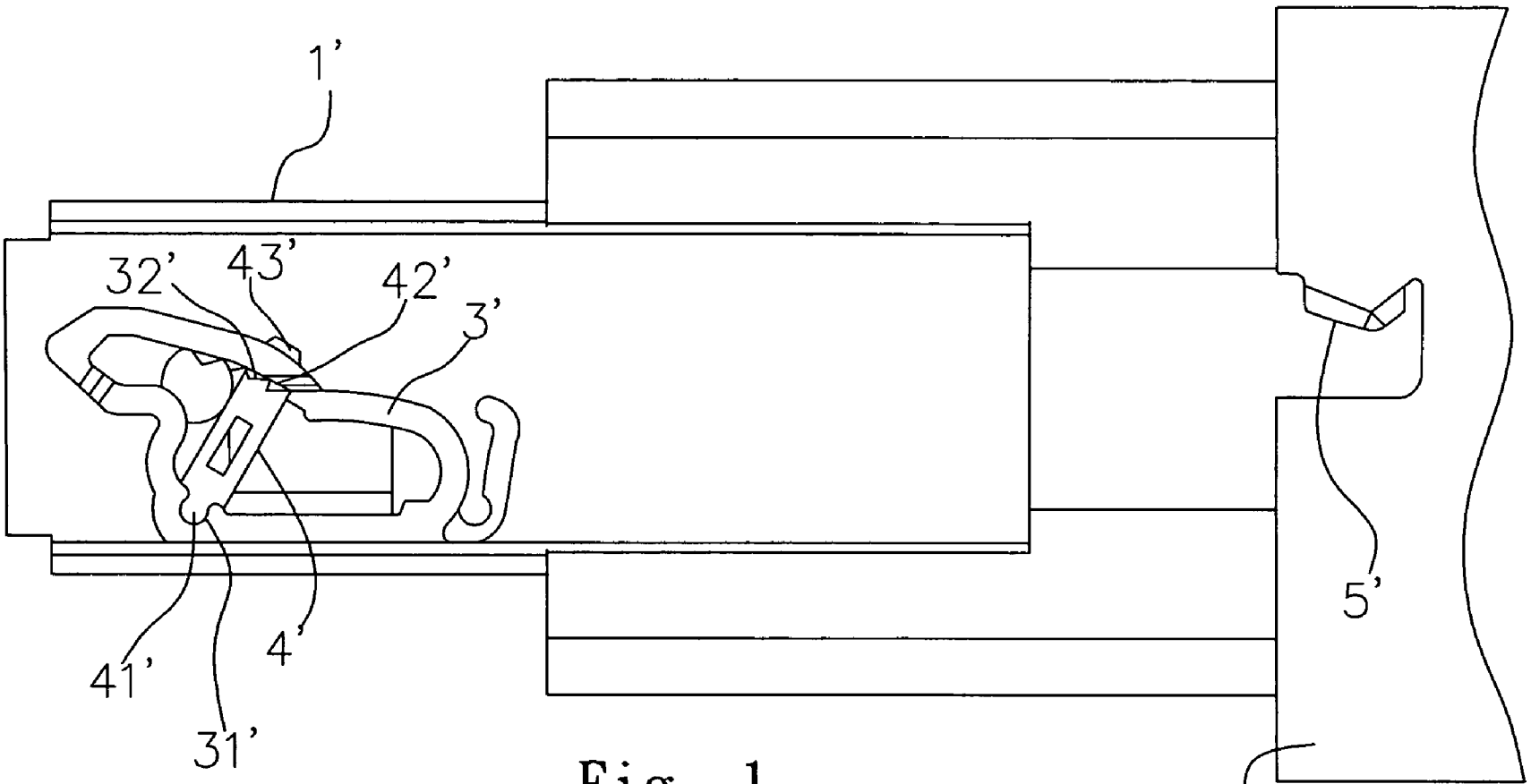
Fig. 1 (Prior Art)
FIG. 1 is a schematic view of a conventional apparatus.
Figure 2:
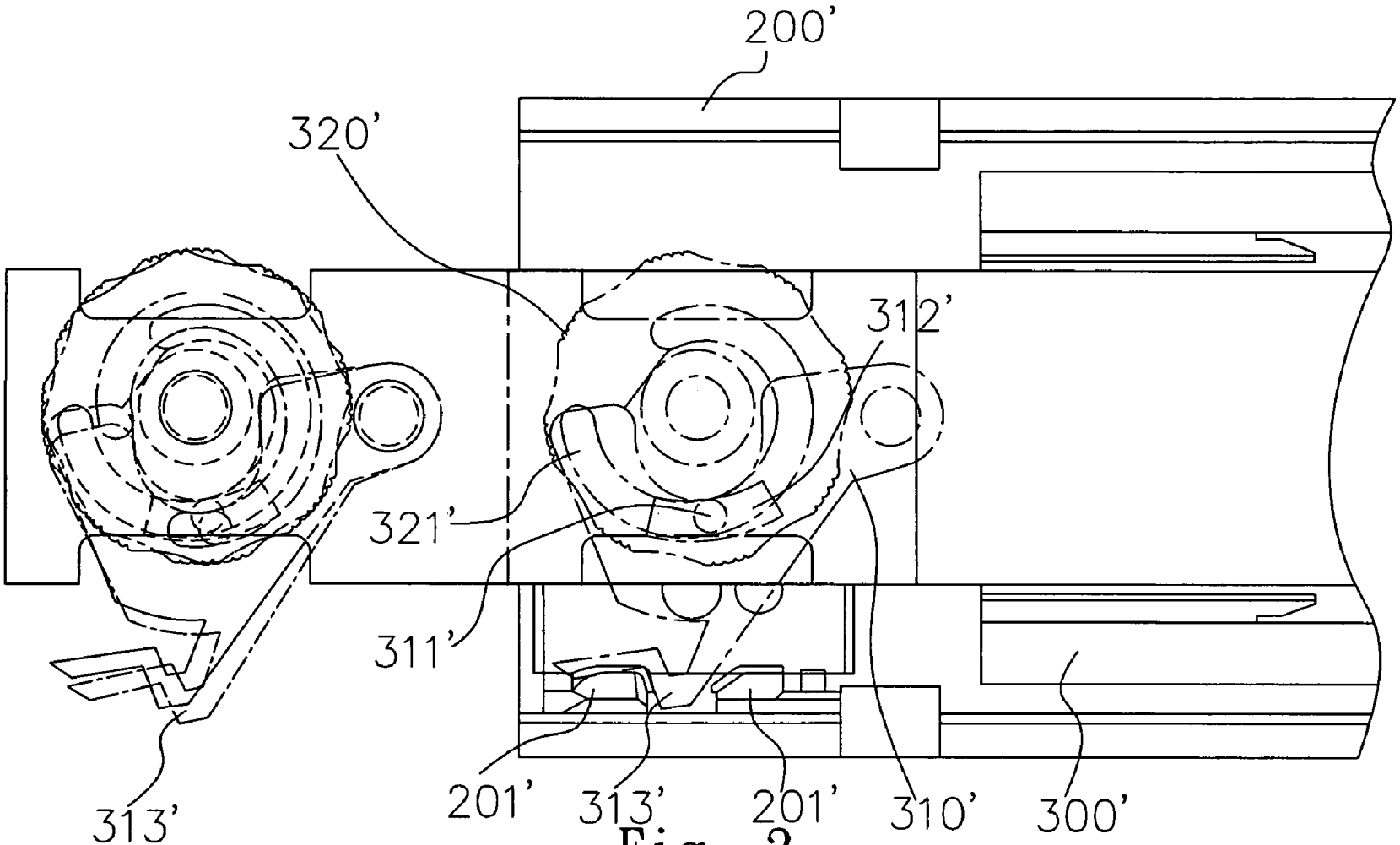
Fig. 2 (Prior Art)
FIG. 2 is a schematic view of another conventional apparatus.
Figure 3:
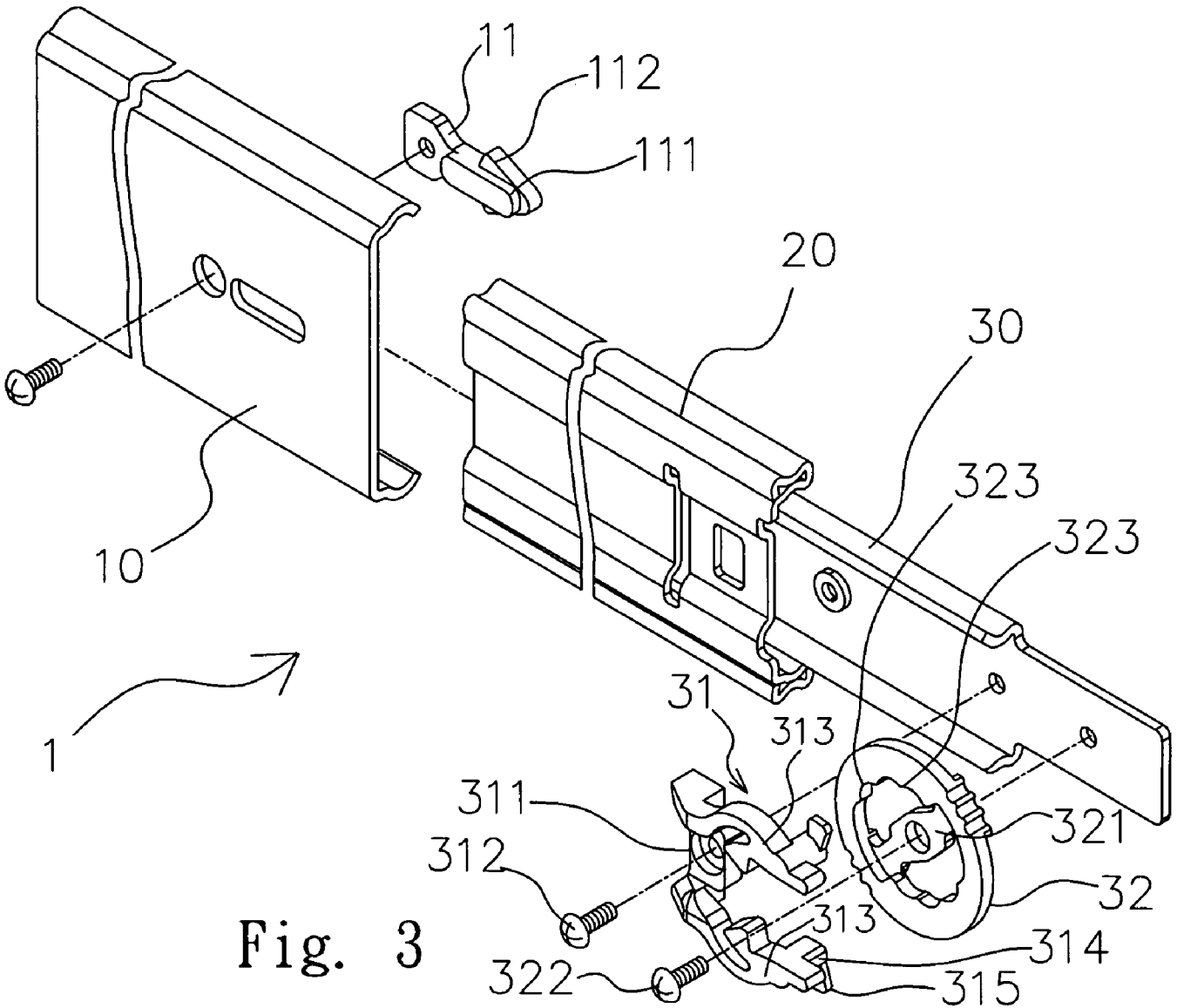
FIG. 3 is an exploded view of the present invention.
Figure 4:
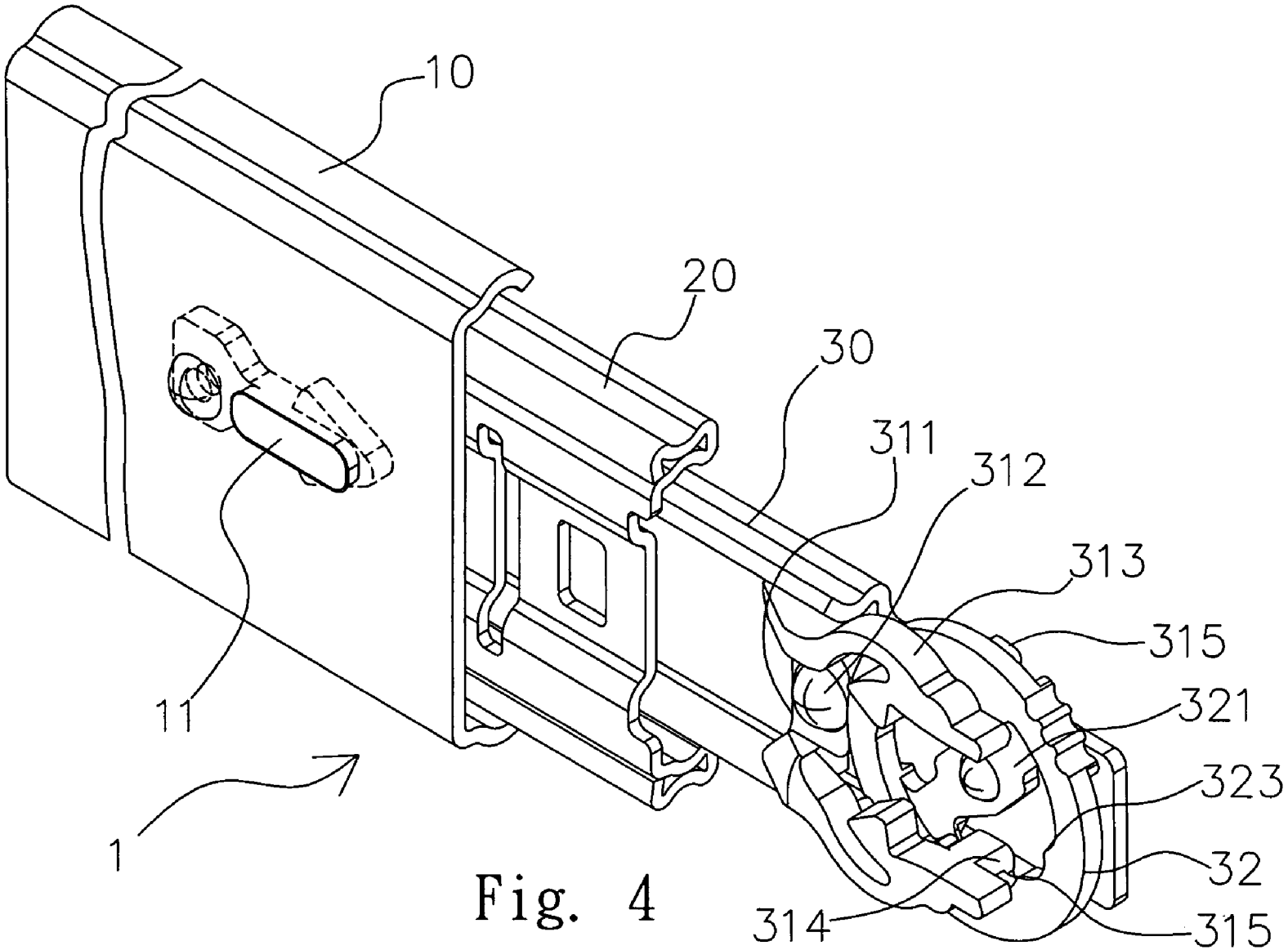
FIG. 4 is a perspective view of the present invention.

Referring to FIGS. 3 to 6 for a wheel type drawer pulling force adjusting apparatus in accordance with the present invention, the apparatus is installed on a slide module 1, and the slide module 1 includes a bottom rail 10, which is substantially a U-shaped frame, and the bottom rail 10 can be fixed on two opposite walls of a cabinet (not shown in the figure) of a cabinet, and a latch member 11 (which is a T-shaped lump in this embodiment) is disposed at an end of the bottom rail 10, and an end of the latch member 11 is secured onto the bottom rail 10, and a tail portion 111 is extended outward from another end of the latch member 11, and a symmetric wing plate 112 is disposed separately on both sides of the tail portion 111.

Further, the bottom rail 10 includes a middle rail 20 (which is substantially a U-shaped frame and there is only one middle rail 20 used in this embodiment) embedded onto the bottom rail 10, and an internal rail 30 (which is substantially a U-shaped frame and there is only one internal rail 30 used in this embodiment) embedded onto the bottom rail 10 and coupled with a drawer (not shown in the figure). The internal rail 30 includes a limit member 31 movably disposed on a surface of the bottom rail 10, and the limit member 31 includes a base 311 secured into the internal rail 30 by a screw rod 312, and symmetric clamping arms 313 are extended respectively outward from both lateral sides of the base 311, and the height of the clamping arms 313 is higher than the base 311, and a separate embedding member 314 is disposed perpendicular to an open end of the clamping arms 313, and a plate member 315 is extended horizontally and respectively from an end of embedding members 314 away from the clamping arms 313.

Further, a turning wheel 32 is installed between the internal rail 30 and the limit member 31, and the turning wheel 32 is a circular plate member in this embodiment, and a rib portion 321 is passed through the turning wheel 32 and secured onto the internal rail 30 by a screw rod 322, and positioning slots 323 with different internal diameters or sizes are disposed concavely and respectively on an internal side of the turning wheel 32.

Figure 5:
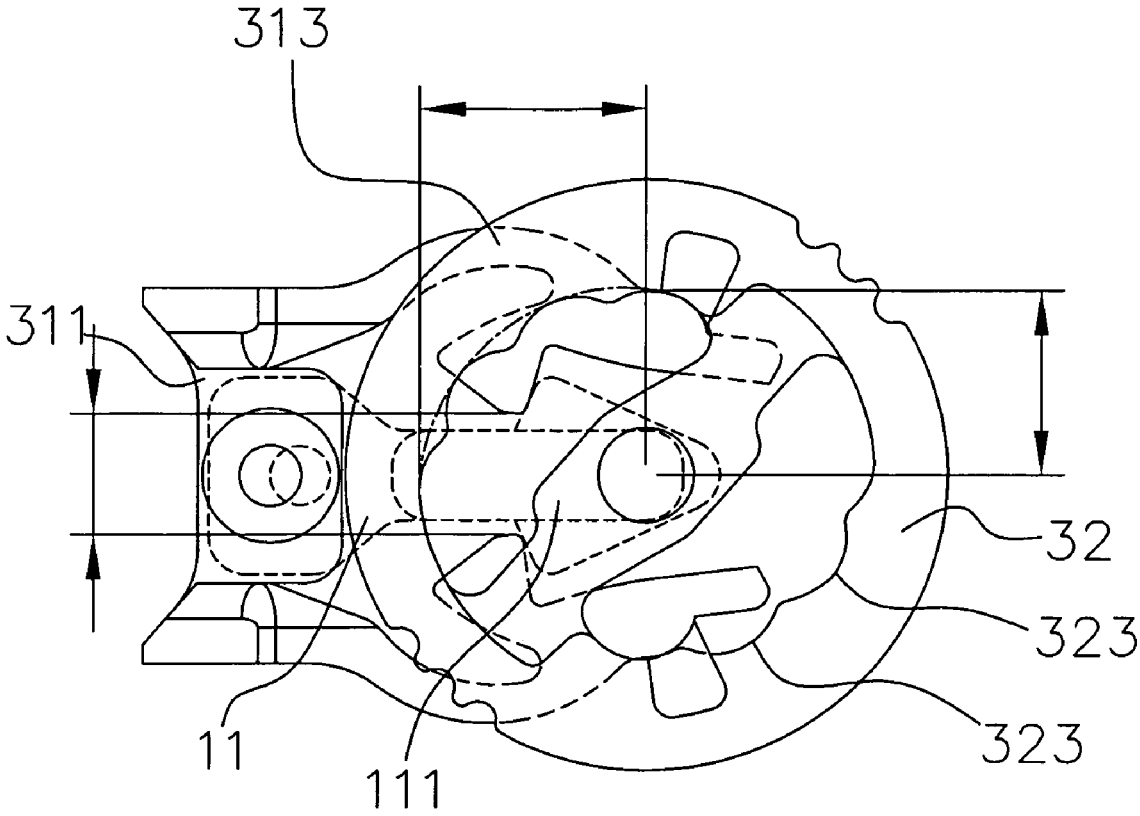
FIG. 5 is a schematic view of turning a wheel to an angle in accordance with the present invention.
Figure 6:
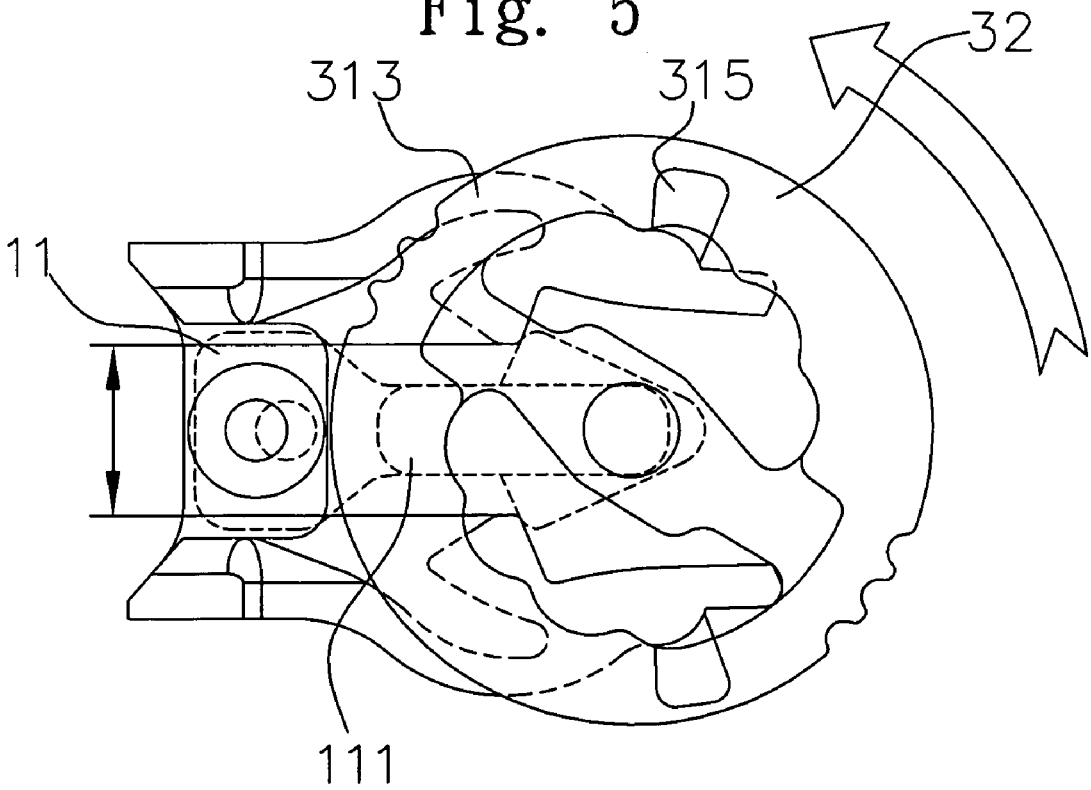
FIG. 6 is another schematic view of turning a wheel to an angle in accordance with the present invention.
Figure 7:
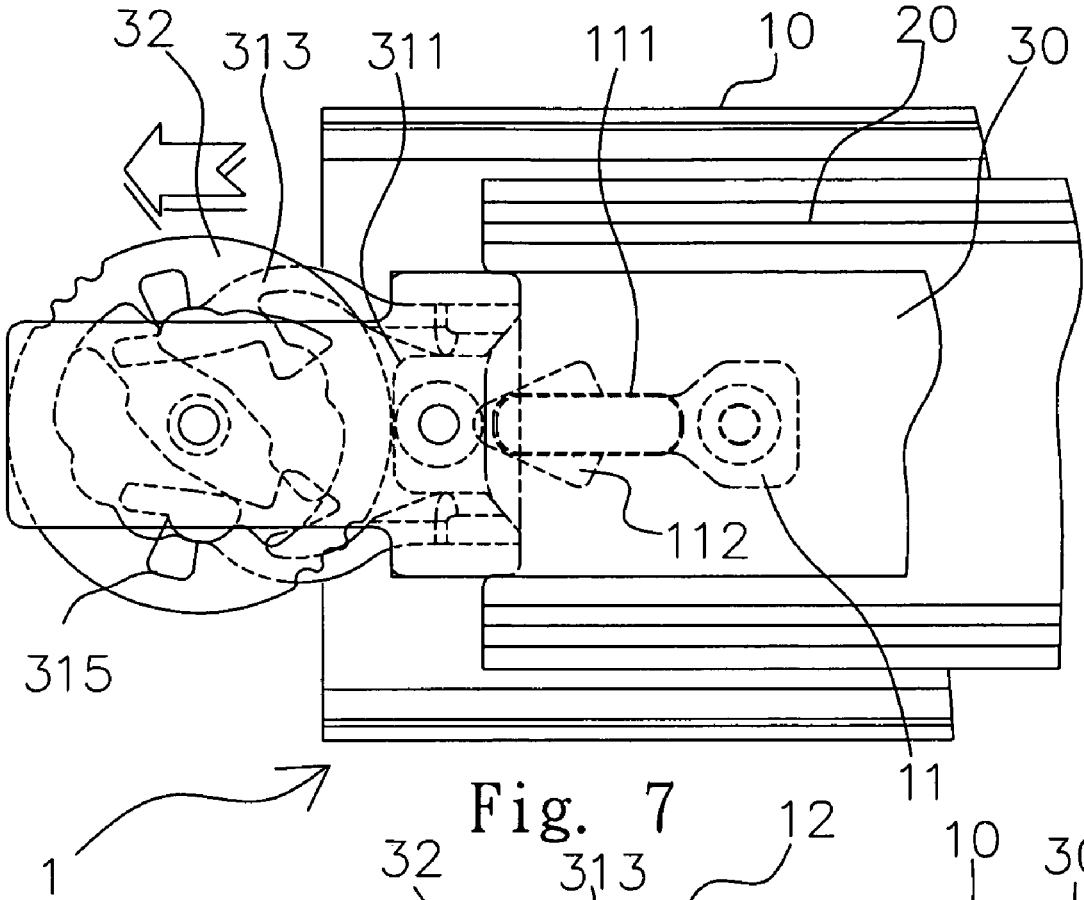
FIG. 7 is a schematic view of a latch member entering into a limit member in accordance with the present invention.
Figure 8:
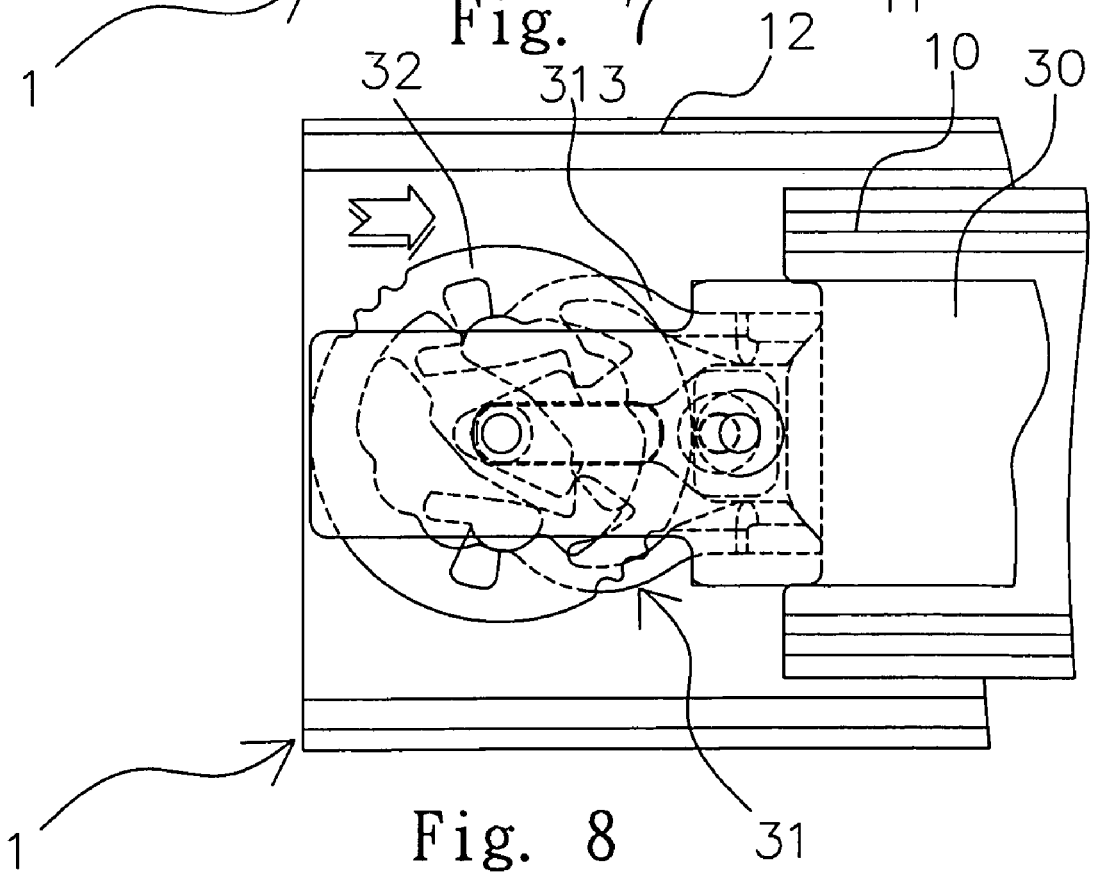
FIG. 8 is another schematic view of a latch member entering into a limit member in accordance with the present invention.

Referring to FIGS. 7 and 8 for the installation, the middle rail 20 and the internal rail 30 are installed sequentially on the bottom rail 10, and the latch member 11 is fixed to an end of the bottom rail 10. In FIGS. 5 and 6, the turning wheel 32 is turned to a specific position if needed, so that the plate members 315 at both ends of the limit member 31 are passed through the turning wheel 32 respectively and leaned onto another side of the turning wheel 32 for engaging an embedding member 314 (not shown in the figure) with the corresponding positioning slot 323. The level of retracting the clamping arms 313 of the limit member 31 is determined by the internal diameter or size of the positioning slots 323 and the tightness of the clamping arms 313 of the limit member 31 latched to the latch member 11 depends on the level of retracting the clamping arms 313, such that the installed bottom rail 10 of the slide module 1 is fixed onto a lateral side of the cabinet (not shown in the figure) to allow users to apply an appropriate force to open the drawer. The present invention achieves the simple-to-install and convenient-to-use effects.

In summation of the description above, the present invention herein enhances the performance than the conventional structure and further complies with the patent application requirements and is duly filed for patent application.

While preferred embodiments of the invention have been shown and described in detail, it will be readily understood and appreciated that numerous omissions, changes and additions may be made by persons ordinarily skilled in the art without departing from the spirit and scope of the invention.

What is claimed is:

1. A wheel type drawer pulling force adjusting apparatus, comprising:

a bottom rail, having a latch member protruded from an end of said bottom rail;

at least one middle rail, embedded onto said bottom rail, for sliding on said bottom rail reciprocally;

an internal rail, embedded onto said middle rail, for sliding on said middle rail reciprocally;

a limit member, fixed onto said internal rail, and including a base, symmetric clamping arms extended outward from both lateral sides of said base, an embedding member disposed perpendicularly and respectively on open ends of said clamping arms, and a first plate member horizontally and extended from ends of said embedding members away from said clamping arms; and a turning wheel, fixed onto said internal rail, and installed between said internal rail and said limit member, and an internal side of said turning wheel having a plurality of positioning slots with different internal diameters, and a second plate member disposed under said embedding members passing through a first side of said turning wheel, and leaning against a second side of said turning wheel;

thereby, when said apparatus is in use, a level of retracting clamping arms of said limit member depends on the internal diameter of said positioning slots of said turning wheel latched with said embedding member of said limit member, and a tightness of said clamping arms of said limit member clamped on said latch member of said bottom rail latch member is adjustable for allowing a user to apply an appropriate force to open a drawer.

2. The wheel type drawer pulling force adjusting apparatus according to claim 1, wherein said bottom rail, said slide rail and said internal rail are U-shaped frames.

3. The wheel type drawer pulling force adjusting apparatus according to claim 1, wherein said clamping arms have a height greater than said base.

4. The wheel type drawer pulling force adjusting apparatus according to claim 1, wherein said turning wheel includes a rib portion secured on said internal rail by a locking rod.

5. The wheel type drawer pulling force adjusting apparatus according to claim 1, wherein said latch member is substantially a T-shaped lump, and an end of said latch member is secured onto said bottom rail, and a tail portion extended outward from another end of said latch member, and a symmetric wing plate is disposed separately on both sides of said tail portion.

6. The wheel type drawer pulling force adjusting apparatus according to claim 5, wherein said clamping arms of said limit member are clamped to both sides of said wing plate of said latch member.

* * * * *